US012359449B2

(12) United States Patent
Dean et al.

(10) Patent No.: US 12,359,449 B2
(45) Date of Patent: Jul. 15, 2025

(54) DEVICE FOR TILING

(71) Applicant: Werld Australia Pty Ltd, Soldiers Hill (AU)

(72) Inventors: Joe Dean, Soldiers Hill (AU); Denis Sheehan, Soldiers Hill (AU)

(73) Assignee: Werld Australia Pty Ltd, Soldiers Hill (AU)

( * ) Notice: Subject to any disclaimer, the term of this patent is extended or adjusted under 35 U.S.C. 154(b) by 130 days.

(21) Appl. No.: 18/267,597

(22) PCT Filed: Dec. 20, 2021

(86) PCT No.: PCT/AU2021/051523
§ 371 (c)(1),
(2) Date: Jun. 15, 2023

(87) PCT Pub. No.: WO2022/133520
PCT Pub. Date: Jun. 30, 2022

(65) Prior Publication Data

US 2024/0052646 A1 Feb. 15, 2024

(30) Foreign Application Priority Data

Dec. 22, 2020 (AU) ..... 2020904786

(51) Int. Cl.
*E04F 21/02* (2006.01)

(52) U.S. Cl.
CPC ..... *E04F 21/023* (2013.01)

(58) Field of Classification Search
CPC .... B05C 1/025; B65D 83/0044; E04F 21/023
USPC ..... 222/405; 401/150, 178, 181, 263–266
See application file for complete search history.

(56) References Cited

U.S. PATENT DOCUMENTS 1,065,823 A * 6/1913 Matthews ..... G01F 11/286 222/386
4,394,844 A 7/1983 Wood et al.
4,948,078 A * 8/1990 Dumenigo ..... A47K 5/1201 248/176.1

(Continued)

FOREIGN PATENT DOCUMENTS

| | | |
|---|---|---|
| EP | 0564362 | 6/1996 |
| JP | 60186067 | 12/1985 |
| JP | 06071632 | 3/1994 |

OTHER PUBLICATIONS

International Search Report and Written Opinion for PCT Application No. PCT/AU2021/051523, mailed Mar. 23, 2022, 8 pages.

*Primary Examiner* — David P Angwin
*Assistant Examiner* — Bradley S Oliver
(74) *Attorney, Agent, or Firm* — Ganz Law, PC

(57) ABSTRACT

Embodiments of the present invention relate to a device for tiling comprising a container for holding a tiling adhesive, and a discharger for discharging the tiling adhesive. The discharger comprises at least one aperture and is configured to fit in the inner portion of the container, wherein the device is configured such that when the discharger is placed in the inner portion of the container and a rear face of a tile is placed on a top surface of the discharger, adhesive within the container can move through the at least one aperture of the discharger to apply a portion of the tiling adhesive to the rear face of the tile.

18 Claims, 8 Drawing Sheets

(56) References Cited

U.S. PATENT DOCUMENTS

| | | | | |
|---|---|---|---|---|
| 5,411,182 | A | 5/1995 | Marte et al. | |
| 8,371,480 | B2 * | 2/2013 | Wang | A45D 34/04 222/320 |

* cited by examiner

DEVICE FOR TILING

TECHNICAL FIELD

The present invention relates to a device and method for tiling. In particular, the present invention relates to a device and a method for applying an adhesive to a tile.

BACKGROUND

The conventional process of applying an adhesive to a tile is done by hand which is labour intensive and time consuming. Also, adhesive applied by hand is not consistent which can have an impact on the overall tiling process and the end result. There are generally two methods of application. A first one is to apply the adhesive directly to the surface or substrate to be tiled by means of trowels with notched surfaces or edges. The second one is to apply the adhesive to the rear face of the tile using trowels that have straight or notched edges. The notches in both cases gauge the adhesive into uniform amounts, leaving air spaces for glue movement and settlement during the laying process.

All manual processes of applying adhesive to a tile have the problem that the material is typically applied inconsistently. This may have a negative impact on the end result as the finished lay of tiles may be uneven. It would therefore be advantageous if at least an embodiment of the present invention overcome the problems of the conventional process or at least provided a workable alternative.

Any discussion of documents, acts, materials, devices, articles or the like which have been included in the present specification is not to be taken as an admission that any or all of these matters form part of the prior art base or were common general knowledge in the field relevant to the present invention as it existed before the priority date of each claim of this application.

Throughout the specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

SUMMARY

Embodiments of the present invention relate to a device for tiling, the device comprising:

- a container for holding a tiling adhesive, the container having substantially vertical walls defining an inner portion of the container, the container further comprising an opening at a top portion of the container;
- a discharger for discharging the tiling adhesive, the discharger comprising at least one aperture and being configured to fit in the inner portion of the container;
- wherein the device is configured such that when the discharger is placed in the inner portion of the container and a rear face of a tile is placed on a top surface of the discharger, adhesive within the container can move through the at least one aperture of the discharger to apply a portion of the tiling adhesive to the rear face of the tile.

Embodiments of the present invention provide significant advantages. In particular, the device may reduce the time and labour for applying adhesive to a tile compared with traditional methods as described above. Furthermore, due to the relatively simple design and configuration of the device, manufacturing is of the device is scalable to suit a larger range of tile sizes. Also, at least an embodiment of the device facilitates an accurate, consistent and predictable adhesive delivery. Thus, adhesive consumption can be more accurately calculated and prepared for which may reduce the wastage of tiling adhesive.

In an embodiment, the device is configured such that the discharger is moveable within the inner portion of the container in a substantially vertical direction. Thus, when tiling adhesive is in the container and a force is applied to the top surface of the discharger positioned in the inner portion of the container, the discharger is lowered and applies pressure on the tiling adhesive thereby causing a portion of the tiling adhesive to move through the at least one aperture of the discharger.

In an embodiment, the discharger is in the form of a substantially flat plate.

In an embodiment, the device is configured such that the discharger moves evenly in a substantially vertical direction within the inner portion of the container. In this way, the top surface of the discharger can be maintained at a substantially constant level. The device may for example comprise guiding elements such that the discharger moves along the guiding elements. Specifically, the container may comprise a track or a bar for engaging with an edge of the discharger.

In an embodiment, the discharger may comprise a plurality of apertures.

The discharger may be made of any suitable material, including but not limited to plastics, aluminium, stainless steel or a combination of the aforementioned.

In an embodiment, a shape and size of the discharger is defined by the cross-section of the inner portion of the container. For example, the discharger may be configured to fit snugly into the inner portion of the container such that a majority of the tiling adhesive moves through the at least one aperture when the discharger is lowered within the inner portion of the container. No or only a relatively small gap may be formed between edges of the discharger and the walls of the container where tiling adhesive may move through.

In an embodiment, the discharger may comprise a sealing material provided at edges of the discharger for facilitating a snug fit between the discharger and the walls of the container.

In an embodiment, the device may be configured such that one or more of the plurality of apertures can be selectively closed. For example, the device may comprise a closure layer for positioning above and/or below the discharger to close one or more of the plurality of apertures. Additionally or alternatively, the device may comprise one or more closure elements for positioning within respective apertures of the discharger.

In an embodiment, the plurality of apertures may be arranged to substantially match a size and shape of the tile. For example, the plurality of apertures may be arranged in a geometrical pattern, such as a rectangular pattern or a square pattern. However, a person skilled in the art will appreciate that other geometrical patterns are envisaged.

In an embodiment, the at least one aperture is squared. Alternatively, the at least one aperture may be round. In a further example, the at least one aperture has a square shape with rounded edges. A person skilled in the art will appreciate that any suitable shape of the at least one aperture is envisaged.

In an embodiment, the at least one aperture may comprise a rim that protrudes from a surface area defined by the discharger, such as by the flat plate of the discharger. The rim may be substantially straight so that a flat contact surface is defined for contacting a tile. Alternatively, the rim may be curved. In this way, the rim may define elevated sections such as corners or side portions. In an embodiment, the container has a rectangular cross section. In a specific embodiment, the container has a square cross section.

The container may be made of any suitable material, including but not limited to plastics, aluminium, stainless steel or a composition of the aforementioned. The container may further comprise a sealing material for facilitating a snug fit between the discharger and the walls of the container.

In an embodiment, the discharger may comprise at least one lifting element for lifting the discharging element from the container. For example, the discharger may comprise one or more protrusions that facilitate lifting the discharger. In one specific example, the discharger comprises two pairs of protrusions that are configured for gripping by a user. However, other suitable lifting elements are envisaged, such as loops.

In an embodiment, the device may comprise an applicator for applying a force to the top surface of the discharger. Specifically, the applicator may comprise a base for engaging with the top surface of the discharger, the base being connected to a handle. In one example, the handle may be pivotably connected to the container such that by pivoting the handle, the base applies a force to the top surface of the discharger. Thus, when a tile is positioned on the top surface of the discharger and the handle is pivoted, the base applies a force to the tile and thereby to the top surface of the discharger. In this way, the tile is secured in position and tiling adhesive is applied to the rear face of the tile through the at least one aperture.

The base may comprise an enlarged surface area for engaging with the top surface of the discharger. This provides the advantage that the discharger may be maintained at a substantially constant level when moving within the inner portion of the container.

The base may be connected to the handle via a joint. Thus, when the handle is pivoted, the base maintains engagement with the tile. In a further example, the applicator may comprise an extension connecting the base and the handle via respective joints. This has the particular advantage that the applicator may be positioned flat against the top surface of the discharger.

In an embodiment, the device may further comprise a lid for closing the opening of the container. The lid may seal the container air-tight to stop the tiling adhesive from hardening.

Embodiments of the present invention relate to a method of applying adhesive to a tile, the method comprising:

- providing a device for tiling, the device comprising a container for holding a tiling adhesive and a discharger; the container having substantially vertical walls defining an inner portion of the container and further comprising an opening at a top portion of the container; the discharger comprising at least one aperture and being configured to fit in the inner portion of the container;
- filling the container with tiling adhesive;
- positioning the discharger in the inner portion of the container;
- positioning a tile on the top surface of the discharger; and
- applying pressure to the tile such that a portion of the adhesive within the container moves through the at least one aperture of the discharger to apply tiling adhesive to the rear face of the tile.

The method may comprise a step of removing the tile from the top surface of the discharger. Once the tile is removed, a portion of the tiling adhesive is placed on the rear face of the tile. For example, if the discharger of the device comprises a plurality of apertures in a geometrical pattern, the rear face of the tile comprises portions of the tiling adhesive in substantially the same geometrical pattern. In this way, uniform amounts of tiling adhesive can be placed on the tile including spaces between the amounts for movement and settlement of the adhesive.

It will be appreciated by persons skilled in the art that numerous variations and/or modifications may be made to the invention as shown in the specific embodiments and/or aspects without departing from the spirit or scope of the invention as broadly described. For example, it will be apparent that certain features of the invention can be combined to form further embodiments. The present embodiments and aspects are, therefore, to be considered in all respects as illustrative and not restrictive. Several embodiments are described above with reference to the drawings. These drawings illustrate certain details of specific embodiments that implement the systems and methods and programs of the present invention. However, describing the invention with drawings should not be construed as imposing on the invention any limitations associated with features shown in the drawings.

BRIEF DESCRIPTION OF DRAWINGS

Certain exemplary embodiments of the present invention will now be described, by example only, with reference to the accompanying drawings in which.

DESCRIPTION OF EMBODIMENTS

Figure 1:
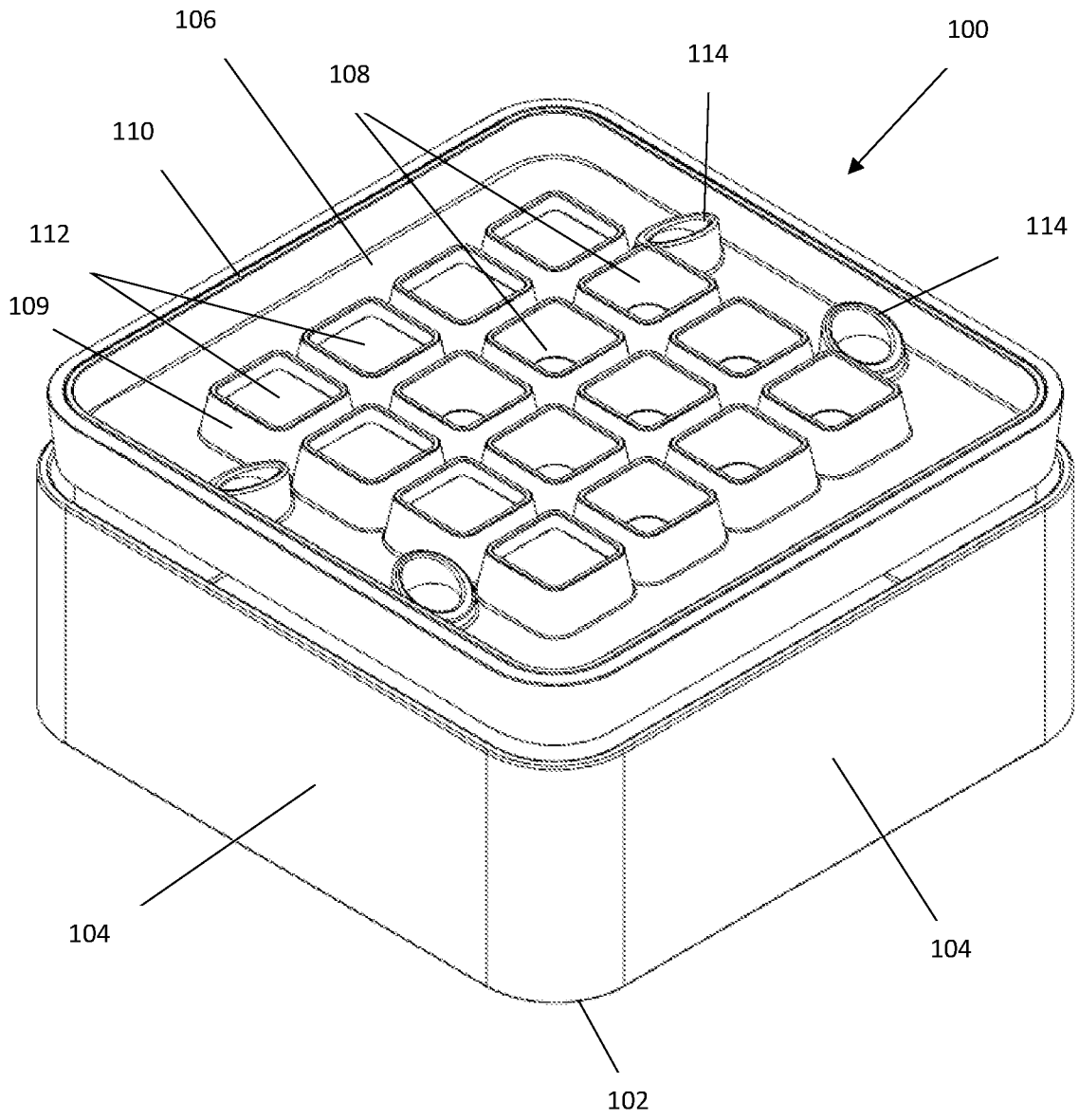
FIG. 1 is a schematic representation of a device for tiling in accordance with an embodiment of the present invention.
Figure 2:
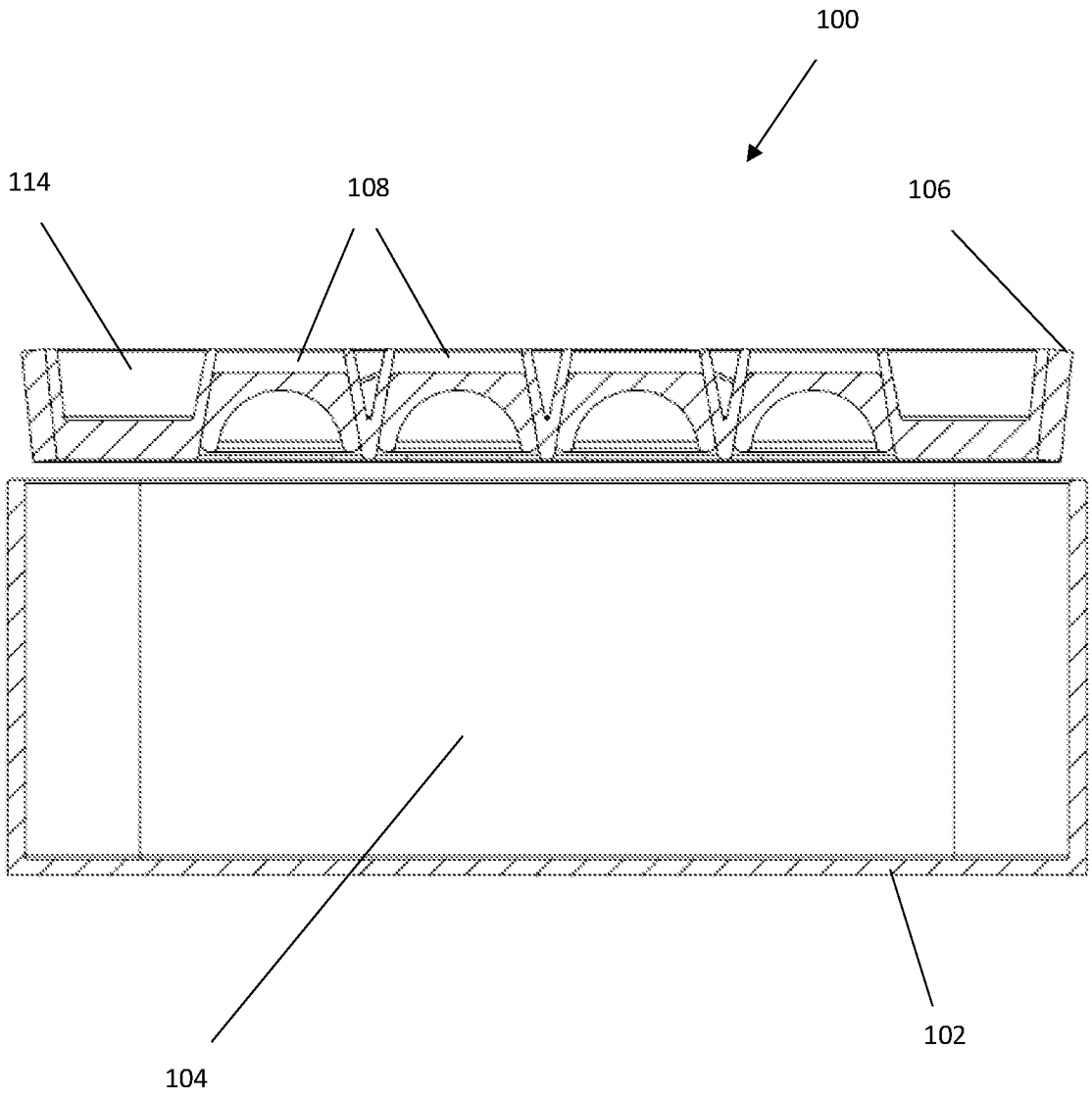
FIG. 2 is a side view of the device of FIG. 1.
Figure 3:
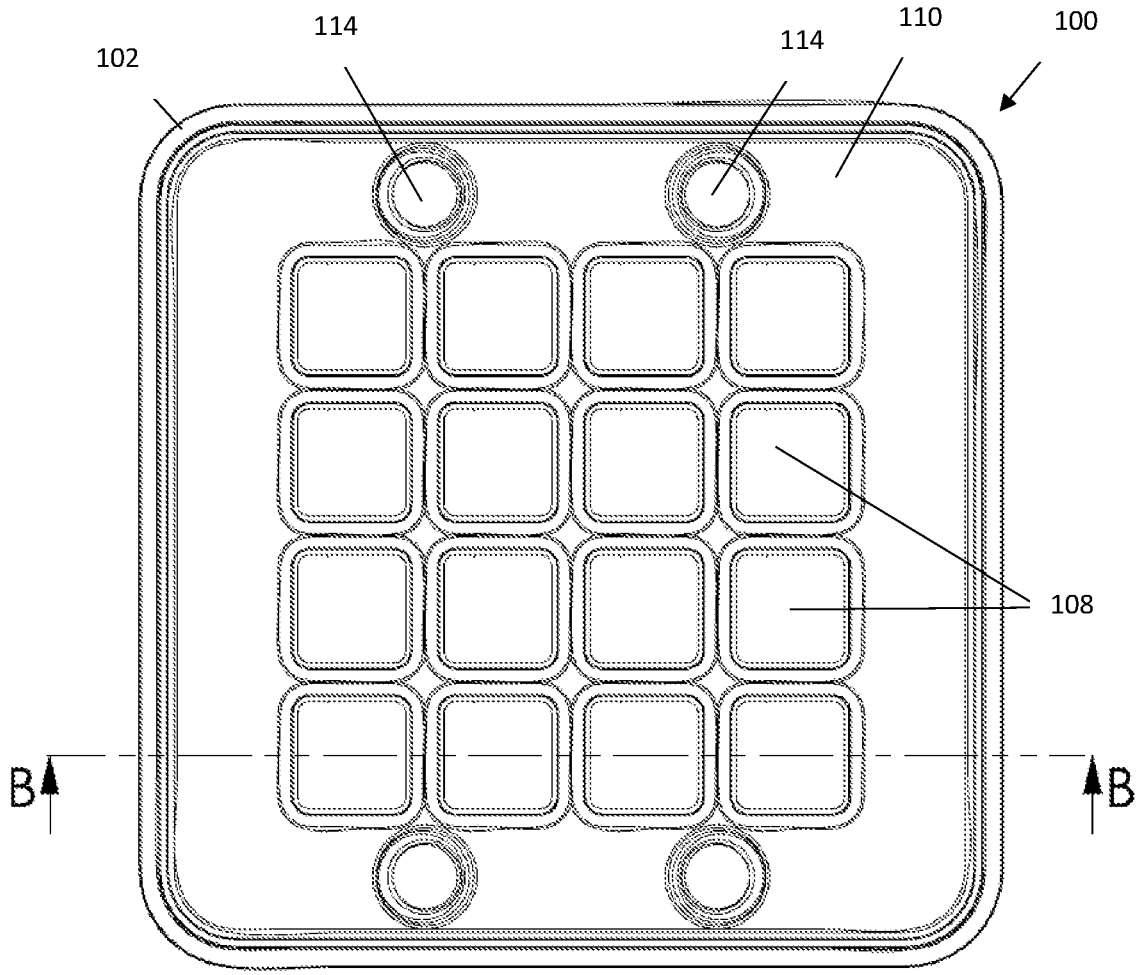
FIG. 3 is a top view of the device of FIG. 1.
Figure 4:
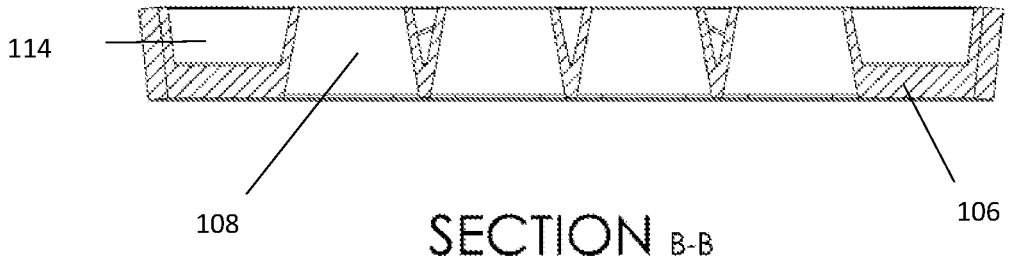
FIG. 4 is a schematic side illustrating a section of the device of FIG. 3 along line B-B.

Embodiments of the present invention generally relate to a device for tiling, such as a device for applying adhesive to a tile and a method of applying adhesive to a tile. The device comprises a container for holding a tiling adhesive. The container has substantially vertical walls that define an inner portion of the container. The walls are typically rigid to avoid any buldging of the container. The container comprises an opening at a top portion of the container that may be closable with a lid.

The device further comprises a discharger for discharging the tiling adhesive, for example, on a rear face of a tile. The discharger comprises at least one aperture and is configured to fit in the inner portion of the container. The device is configured such that when the discharger is positioned in the inner portion of the container and a rear face of a tile is placed on a top surface of the discharger, adhesive within the container can move through the at least one aperture of the discharger to apply a portion of the tiling adhesive to the rear face of the tile.

Embodiments of the present invention provide significant advantages. In particular, at least an embodiment of the present invention reduces the time and labour to a fraction of the time that a manual application process would take. The inventor of the present invention has found that it is possible to apply adhesive to 10-20 tiles in the time it takes to manually apply adhesive to a few tiles. Thus, embodiments of the present invention provide for an economical, faster, more accurate and cleaner method of applying tiling adhesive before laying.

Referring now to FIGS. 1 to 4, there is illustrated a device 100 for tiling in accordance with a first embodiment of the present invention. The device 100 comprises a container 102 that has four substantially vertically extending walls 104 that define an inner portion of the container 102. In this particular example, a cross-section of the container 102 is in the shape of a square with rounded edges. However, a person skilled in the art will appreciate that any suitable cross-sectional shape of the container 102 is envisaged. The person skilled in the art will understand that the selection of the shape and size of the container 102 will mostly depend on the shape and size of the tile on which the tiling adhesive is to be applied.

Exemplary dimensions of the device 100 may range from be 10 cm×10 cm×5 cm (W×D×H) for relatively small tiles to 100 cm×100 cm×30 cm (W×D×H) for relatively large squared tiles. However, a person skilled in the art will understand that tiles can be provided in a variety of shapes and sizes, including but not limited to 10 cm×20 cm, 20 cm×20 cm, 30 cm×30 cm, 45 cm×45 cm, and 90 cm×90 cm (or inches). Thus, the device may be provided in any suitable dimensions to accommodate these tiles.

The container 102 comprises a top portion that is open so that the container 102 can be filled with a tiling adhesive and so that a tile can be received for applying the tiling adhesive. The device 100 may be used with any tiling adhesive that is of a suitable consistency, such as pourable mortar.

The device 100 further comprises a discharger 106 for discharging the tiling adhesive that is contained within the inner portion of the container 102. In this regard, the discharger 106 comprises at least one aperture, in this example, a plurality of apertures 108 through which the tiling adhesive can be discharged. The discharger 106 is in the form of a substantially flat plate 110 that has a cross section of similar shape and size as the container 102. Specifically, the flat plate 110 is shaped and sized so that the discharger 106 snugly fits into the inner portion of the container 102 and at the same time is moveable within the container 102 in a substantially vertical direction. Thus, when the container 102 is filled with a tiling adhesive (not shown) to any desired level and the discharger 106 is positioned within the inner portion of the container 102, by lowering the discharger 106 further into the container, pressure is applied to the tiling adhesive thereby causing a portion of the tiling adhesive to move through the plurality of apertures 108 of the discharger 106. When a rear face of a tile is placed on a top surface of the discharger 106 where the plurality of apertures 108 are located and pressure is applied, tiling adhesive is applied to the tile. In this way, substantially uniform amounts of the tiling adhesive can be applied to the rear face of the tile while leaving air spaces for possible movement and settlement of the adhesive during the laying process.

A further advantage of the device 100 is that due to its relatively simple configuration, the device 100 can be manufactured in a cost-effective manner. Even more so, as will become apparent with the description of further features of the device 100, the device 100 may be used for various sizes and shapes of tiles.

A person skilled in the art will appreciate that there is no limitation as to materials being used for manufacturing components of the device 100, such as the container 102 or the discharger 106. Possible materials include but are not limited to plastics, aluminium, stainless steel, rubber and any combination of the aforementioned.

Referring back to the Figures, it can be seen that the discharger 106 of the device 100 comprises 16 apertures that are arranged in a geometrical pattern, in this example, in the form of a square of 4×4 apertures. Each aperture 108 has a cross sectional shape of a square with rounded corners. Thus, when using the device 100, 16 substantially uniform amounts of tiling adhesive can be applied to a tile that is of similar size as the geometrical pattern defined by the apertures 108.

In this example, each aperture 108 has a rim 109 that is raised relative to a surface area defined by the flat plate 110. The rim 109 has a height that is substantially constant for each aperture. In this way, the rims 109 of the plurality of the apertures 108 define a flat contact surface for contacting the rear face of a tile. The rims 109 of each aperture 108 may extend in a direction to gradually taper towards a top portion of the aperture 108. Thus, a circumference at the top portion of the aperture 108 is smaller than a circumference at a base portion of the aperture 108. However, a person skilled in the art will appreciate that any suitable configuration of the apertures is envisaged with and without rims.

In this example, the device 100 is configured so that one or more of the plurality of apertures 108 are selectively closable. This has the significant advantage that smaller tiles can be used with the same device 100. For example, in order to apply tiling adhesive to a tile that has a size and shape of approximately 3×3 apertures, an outer row of the apertures 108 may be closed as illustrated in FIG. 1 in which the outer left rows of 7 apertures are closed so that no tiling adhesive can move through these apertures.

In this particular example, the device 100 comprises a plurality of closure elements 112 wherein each may be positioned in a respective aperture 108 to close that aperture 108. The closure element may be in the form of a rubber plug or the like. However, other suitable closure elements are envisaged. In an alternative example (not shown), the device 100 may comprise one or more closure layers or profiles to be placed above and/or below the discharger 106. For example, a closure layer may comprise one or more cut-outs for one or more apertures 108 to stay open. Different closure layers may be provided with the device 100 to accommodate for a variety of different shapes and sizes of tiles.

As mentioned above, the device 100 is configured such that the discharger 106 fits snugly within the inner portion of the container 102. In this regard, the discharger 106 may comprise a sealing material provided at edges of the discharger 106, such as rubber or silicon. In this way, it can be ensured that a majority of the tiling adhesive moves through the apertures 108 when the discharger 106 is lowered within the inner portion of the container 102. No or only a relatively small gap may be formed between edges of the discharger 106 and the walls 104 of the container 102 where tiling adhesive may move through. A person skilled in the art will appreciate that alternatively or additionally the container 102 may comprise a sealing material to facilitates a snug fit between the discharger 106 and the container 102. For example, the inner portion of the container 102 may be coated with a sealing material, such as rubber, silicone or the like.

The discharger 106 further comprises at least one lifting element for lifting the discharger 106 from the inner portion of the container 102. In this example, the at least one lifting element is in the form of a pair of recesses 114 provided at an outer portion of the flat plate 110 of the discharger 106. The pair of recesses 114 form finger pulls and are arranged to facilitate that a user may grip the discharger 106 with two fingers on each hand. Whilst in this example the lifting elements 114 are in the form of recesses 114, a person skilled in the art will appreciate that the at least one lifting element may be in any suitable form, such as in the form of one or more loops or protrusions protruding from a top surface of the discharger 106.

Figure 5:
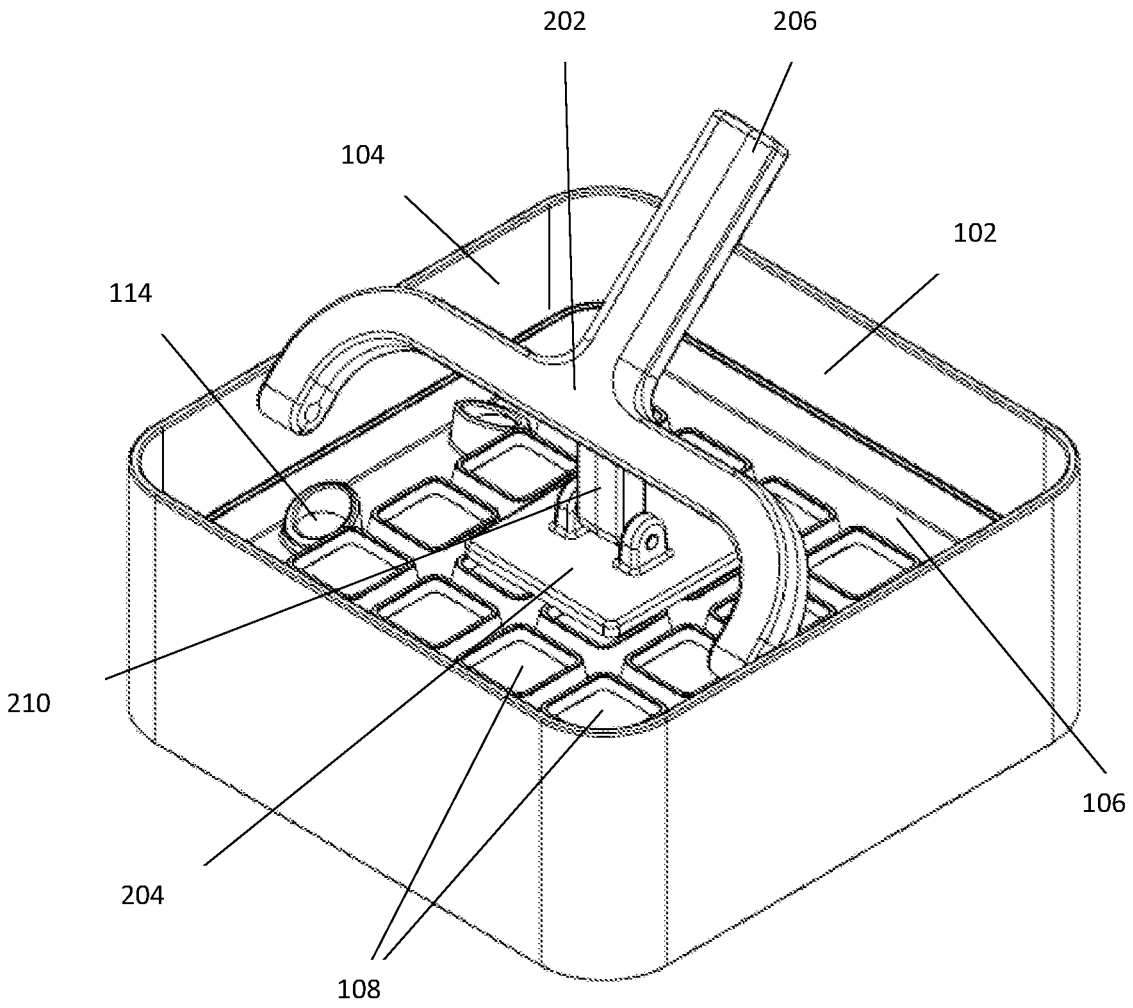
FIG. 5 is a schematic representation of a device for tiling in accordance with a further embodiment of the present invention.
Figure 6:
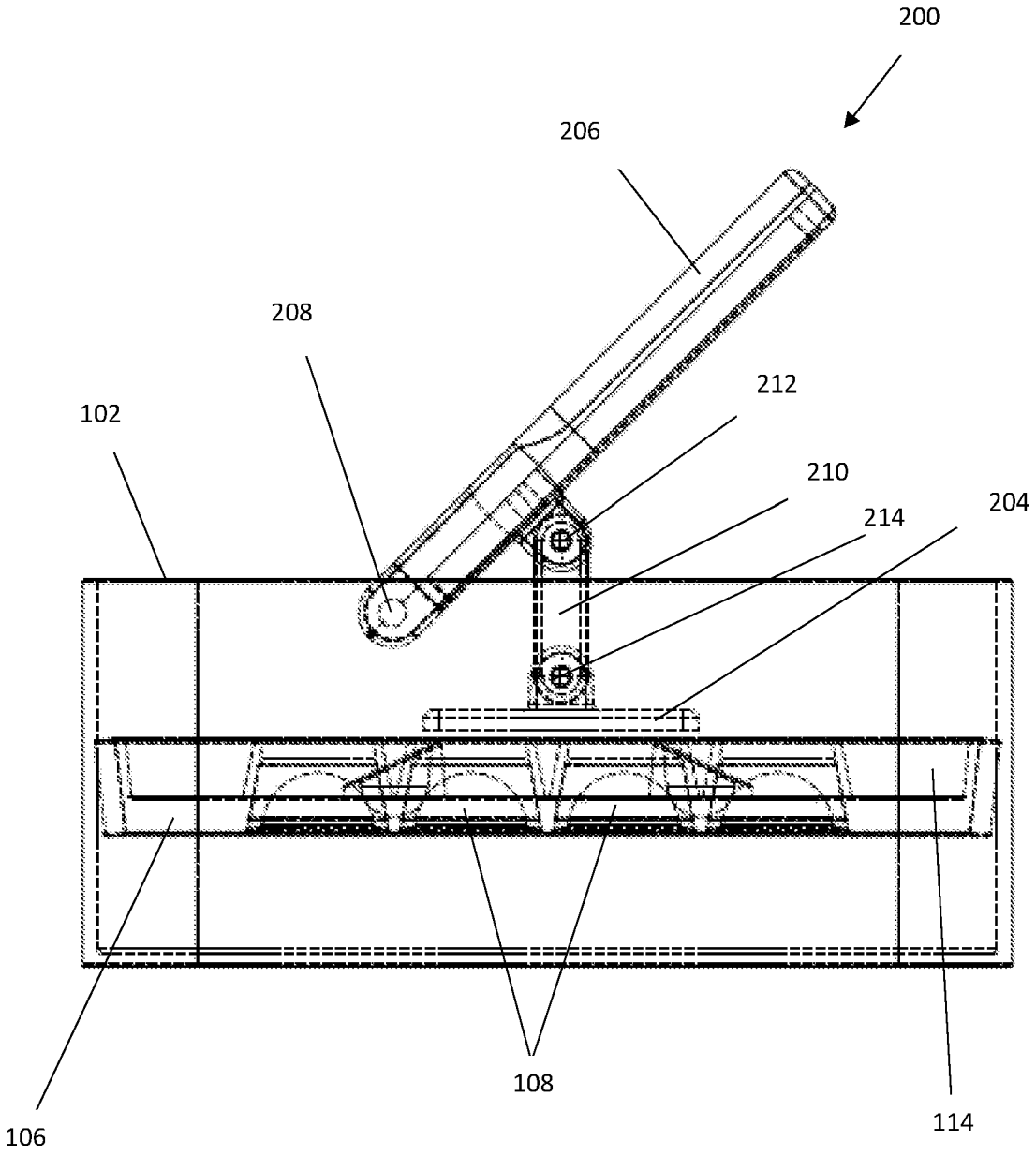
FIG. 6 is a schematic side view of the device shown in FIG. 5.
Figure 7:
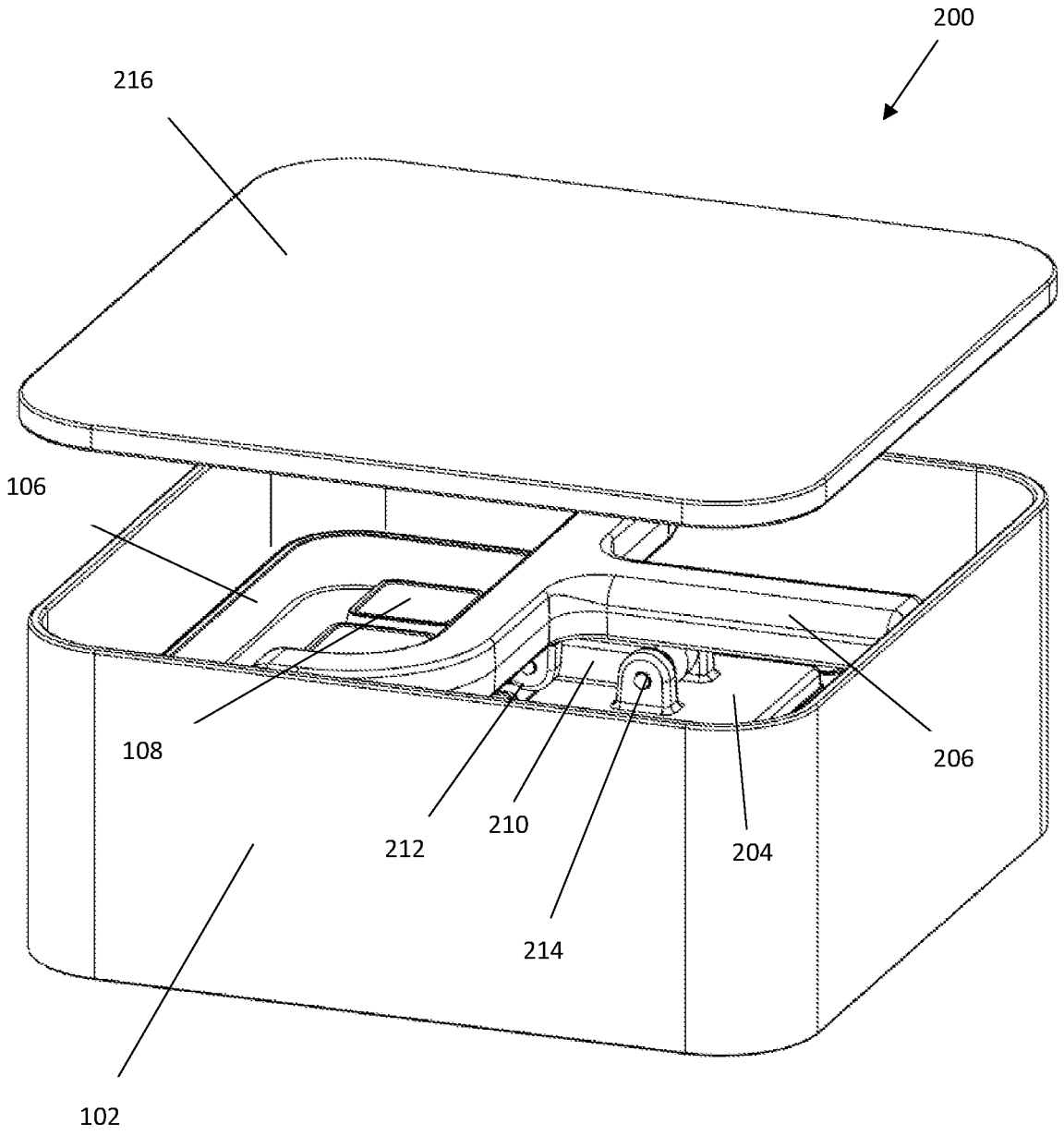
FIG. 7 is a schematic representation of the device of FIG. 5 with a lid.

Referring now to FIGS. 5 to 7 of the accompanying drawings, there is illustrated a device 200 for tiling in accordance with a second embodiment of the present invention. It should be noted that like numerals refer to like components. The device 200 is similar to the device 100 in that the device 200 also comprises a container 102 for holding a tiling adhesive and a discharger 106 with a plurality of apertures 108.

In addition, the discharger 106 of the device 200 comprises an applicator 202 for applying a force to the top surface of the discharger 106, for example, via a tile placed on the top surface of the discharger 106. In this particular example, the applicator 202 comprises a base 204 for engaging with the top surface of the discharger 106 (or the tile) and a handle 206 that is connected to the base 204.

The handle 206 is pivotably connected to the container 102, in this example, via joints 208 at a top portion of opposite walls 104 of the container 102. The applicator 202 is configured such that by pivoting the handle 206, the base 204 applies a force to the top surface of the discharger 106 or a tile when placed on the top surface of the discharger 106. Thus, when a tile is positioned on the top surface of the discharger 106 and the handle is pivoted 206, the base 204 applies a force to the tile and thereby to the top surface of the discharger 106. In this way, the tile is secured in position and tiling adhesive is applied to the rear face of the tile through the plurality of apertures 108.

As shown in particular in FIG. 6, the applicator 202 further comprises an extension 210 between the handle 206 and the base 204. The extension 210 is connected to the handle 206 and the base 204 via respective pivot joints 212, 214. This has the particular advantage that the applicator 202 may be folded to be positioned flat against the top surface of the discharger as shown in FIG. 7.

The base 204 of the applicator 202 has an enlarged surface area for engaging with the top surface of the discharger 106. This has the particular advantage that the discharger 106 moves evenly in a substantially vertical direction within the inner portion of the container 102. In this way, the top surface of the discharger 106 can be maintained at a substantially constant level. Furthermore, by maintaining a substantially constant level of the discharger 106, it can be ensured that the amount of tiling adhesive discharged through the plurality of apertures 108 is substantially uniform.

A person skilled in the art will appreciate that additionally or alternatively, the device 200 may comprise guiding elements to facilitate that the discharger 106 moves evenly within the inner portion of the container 102, such as a track or a bar that is located in the inner portion of the container 102 for engaging with an edge of the discharger 106.

The device 200 in this example further comprises a lid 216 for closing the container 102. The lid 216 may seal the container 102 substantially air-tight to stop or at least slow down the tiling adhesive from hardening.

Figure 8:
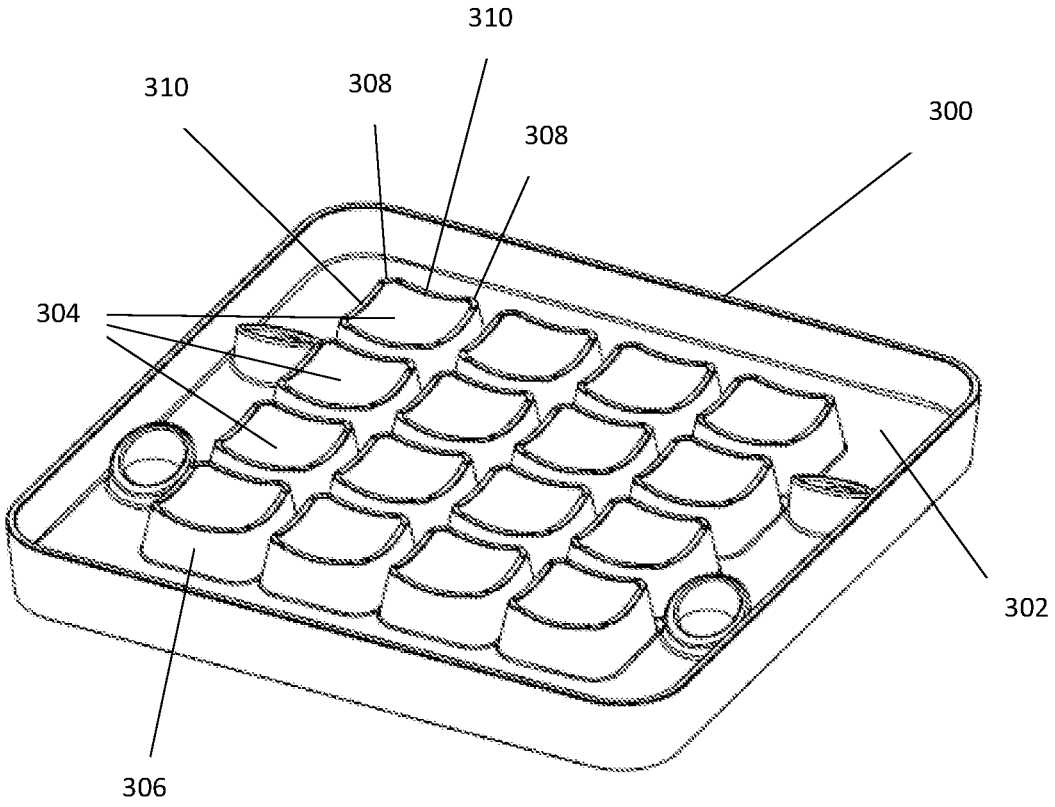
FIG. 8 is a schematic representation of a discharger in accordance with a further embodiment of the present invention.

Referring now to FIG. 8, there is shown an alternative example of a discharger 300 suitable for use with device 100 and device 200. The discharger 300 also has a body in the form of a flat plate 302 which comprises a plurality of apertures 304, each having a squared shape with rounded corners. The apertures 304 are arranged in a geometrical pattern of a square and provided such that tiling adhesive in the container 102 can move through the apertures 304 thereby being applied to the rear face of a tile (not shown). In this example, each aperture 304 comprises a rim 306 that extends along a top edge of the aperture 304 and is raised relative to a surface area defined by the flat plate 302. A top edge of the rim 306 of each aperture 304 is curved to define raised corners 308 that correspond to the four corners of the aperture 304, and lowered side portions 310 that correspond to the four sides of the aperture 304. The inventors of the present invention have found that the process of applying tiling adhesive to a tile can be improved by providing a curved rim 306. Specifically, more tiling adhesive may be applied to the tile compared to a device with a substantially straight rim.

In the examples described above, the devices are configured such that an entire tile can be received on the top surface of the discharger and within the circumference of the vertical walls of the container. In a further example (not shown), a device may be provided that is configured to define a contact surface that is raised relative to a top portion of the container. In other words, the contact surface for contacting a tile is higher than the vertical walls of the container. In this way, it may be possible to apply tiling adhesive to a tile that is larger than a cross-section of the container, similar to a stamp. For example, a tile may be placed on the raised contact surface of the discharger with the plurality of apertures to apply tiling adhesive to an area of the tile. A force may then be applied to the tiling adhesive in the container so as to cause a portion of the tiling adhesive to move through the plurality of apertures. This process may be repeated for other areas on the tile depending on the size of the tile.

Figure 9:
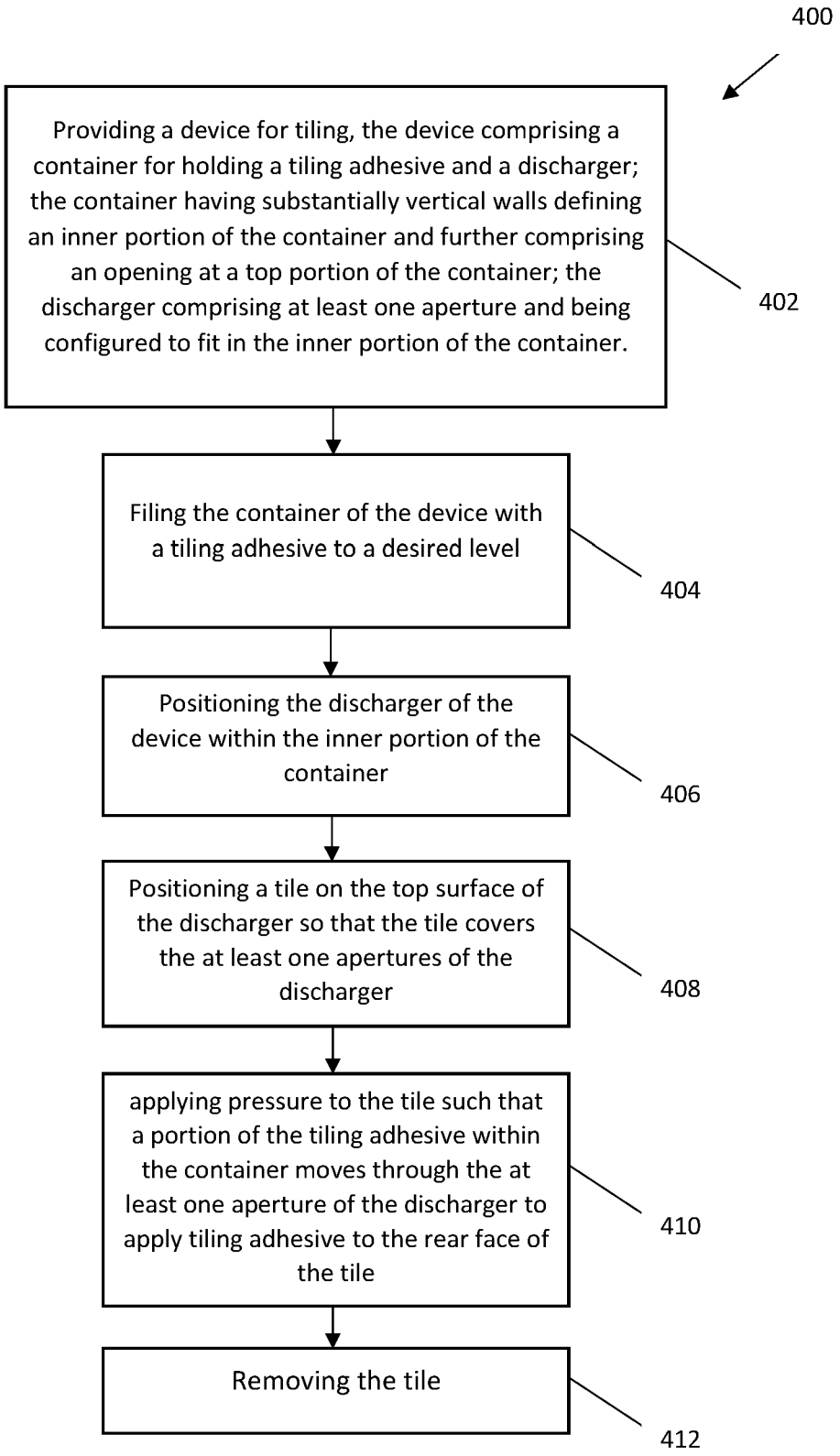
FIG. 9 shows a flow chart illustrating a method of applying adhesive to a tile in accordance with an embodiment of the present invention.

Referring now to FIG. 9, there is shown a flow chart illustrating a method 400 of applying adhesive to a tile. The method 400 comprises a first step 402 of providing a device for tiling, such as device 100 or device 200 described above. In general, a device is provided that comprises a container for holding a tiling adhesive and a discharger. The container has substantially vertical walls defining an inner portion of the container and further comprises an opening at a top portion of the container. The discharger comprises at least one aperture and is configured to fit in the inner portion of the container.

In a further step 404, the container of the device is filled with a tiling adhesive. The discharger of the device is then positioned 406 within the inner portion of the container, for example, so that the discharger rests on the tiling adhesive within the container.

In a further step 408, a tile is positioned on the top surface of the discharger so that the tile covers the at least one aperture of the discharger, such as a plurality of apertures. The method 400 may comprise an optional step of selectively closing one or more of a plurality of apertures to match a size of the tile.

The method 400 also comprises a step 410 of applying pressure to the tile such that a portion of the tiling adhesive within the container moves through the at least one aperture of the discharger to apply tiling adhesive to the rear face of the tile. The pressure may be applied manually directly on the tile or through an applicator as described above. In step 412, the tile is removed from the device with a portion of tiling adhesive placed on the rear face of the tile.

It will be appreciated by persons skilled in the art that numerous variations and/or modifications may be made to the invention as shown in the specific embodiments and/or aspects without departing from the spirit or scope of the invention as broadly described. For example, it will be apparent that certain features of the invention can be combined to form further embodiments. The present embodiments and aspects are, therefore, to be considered in all respects as illustrative and not restrictive. Several embodiments are described above with reference to the drawings. These drawings illustrate certain details of specific embodiments that implement the systems and methods and programs of the present invention. However, describing the invention with drawings should not be construed as imposing on the invention any limitations associated with features shown in the drawings.

The invention claimed is:

1. A device for tiling, the device comprising:

a container for holding a tiling adhesive, the container having substantially vertical walls defining an inner portion of the container, the container further comprising an opening at a top portion of the container;

a discharger for discharging the tiling adhesive, the discharger being in the form of a substantially flat plate and being configured to fit in the inner portion of the container;

wherein the device is configured such that when the discharger is placed in the inner portion of the container and a rear face of a tile is placed on a top surface of the discharger, adhesive within the container can move through the at least one aperture of the discharger to apply a portion of the tiling adhesive to the rear face of the tile, and wherein the discharger comprises a plurality of apertures and each of the plurality of apertures comprises a rim that is raised relative to a surface area defined by the flat plate of the discharger.

2. The device of claim 1 being configured such that the discharger is moveable within the inner portion of the container in a substantially vertical direction.

3. The device of claim 2 being configured such that the discharger moves evenly in a substantially vertical direction within the inner portion of the container.

4. The device of claim 1, wherein a shape and size of the discharger is defined by the cross-section of the inner portion of the container so that the discharger fits snugly into the inner portion of the container.

5. The device of claim 4, wherein the container and/or the discharger comprises a sealing material to facilitate a snug fit between the discharger and the walls of the container.

6. The device of claim 1, wherein the discharger comprises a plurality of apertures.

7. The device of claim 6, being configured such that one or more of the plurality of apertures can be selectively closed.

8. The device of claim 6, wherein the plurality of apertures are arranged to substantially match a size and shape of the tile.

9. The device of claim 1, wherein the container has a substantially square cross section.

10. The device of claim 1, wherein the discharger comprises at least one lifting element for lifting the discharging element from the container.

11. The device of claim 10, wherein the at least one lifting element comprises two pairs of protrusions that are configured for gripping by a user.

12. The device of claim 1, comprising an applicator for applying a force to the top surface of the discharger.

13. The device of claim 12, wherein the applicator comprises a base for engaging with the top surface of the discharger, the applicator further comprising a handle connected to the base, wherein the handle is pivotably connected to the container such that by pivoting the handle, the base applies a force to the top surface of the discharger.

14. The device of claim 13, wherein the base comprises an enlarged surface area for engaging with the top surface of the discharger.

15. The device of claim 13, wherein the base is connected to the handle via a joint.

16. The device of claim 13, wherein the applicator comprises an extension connecting the base and the handle via respective joints.

17. The device of claim 1, further comprising a lid for closing the opening of the container.

18. A method of applying adhesive to a tile, the method comprising:

providing a device for tiling, the device comprising a container for holding a tiling adhesive and a discharger; the container having substantially vertical walls defining an inner portion of the container and further comprising an opening at a top portion of the container; the discharger comprising at least one aperture and being configured to fit in the inner portion of the container;

filling the container with tiling adhesive;

positioning the discharger in the inner portion of the container;

positioning a tile on the top surface of the discharger; and applying pressure to the tile such that a portion of the adhesive within the container moves through the at least one aperture of the discharger to apply tiling adhesive to the rear face of the tile.

* * * * *